US008887604B2

(12) United States Patent
Goettel

(10) Patent No.: US 8,887,604 B2
(45) Date of Patent: Nov. 18, 2014

(54) DRESSER LINK FOR SAW CHAIN

(71) Applicant: Blount, Inc., Portland, OR (US)

(72) Inventor: Mike Goettel, Canby, OR (US)

(73) Assignee: Blount, Inc., Portland, OR (US)

( * ) Notice: Subject to any disclaimer, the term of this patent is extended or adjusted under 35 U.S.C. 154(b) by 0 days.

(21) Appl. No.: 13/802,278

(22) Filed: Mar. 13, 2013

(65) Prior Publication Data

US 2014/0137716 A1 May 22, 2014

Related U.S. Application Data

(60) Provisional application No. 61/728,744, filed on Nov. 20, 2012.

(51) Int. Cl.
*B27B 33/14* (2006.01)
*B27B 17/02* (2006.01)

(52) U.S. Cl.
CPC ..... *B27B 33/14* (2013.01)
USPC ..... 83/174; 83/830; 30/138

(58) Field of Classification Search
USPC ..... 83/174, 834, 835, 846, 848, 788, 830; 30/138
See application file for complete search history.

(56) References Cited

U.S. PATENT DOCUMENTS

| | | | | | |
|---|---|---|---|---|---|
| 2,705,512 | A | * | 4/1955 | Wolf | 83/834 |
| 2,792,035 | A | * | 5/1957 | Aumann | 83/834 |
| 3,516,459 | A | * | 6/1970 | Silvon et al. | 30/138 |
| 4,425,830 | A | | 1/1984 | Atkinson | |
| 4,530,258 | A | * | 7/1985 | Gibson et al. | 76/80.5 |
| 4,785,700 | A | * | 11/1988 | Petrovich et al. | 83/834 |
| 6,871,573 | B2 | | 3/2005 | Mang | |
| 2008/0110316 | A1 | | 5/2008 | Harfst | |
| 2010/0005666 | A1 | | 1/2010 | Seigneur et al. | |
| 2011/0226112 | A1 | | 9/2011 | Englund et al. | |

* cited by examiner

*Primary Examiner* — Ghassem Alie
(74) *Attorney, Agent, or Firm* — Schwabe Williamson & Wyatt

(57) ABSTRACT

Embodiments herein provide a dresser link for a saw chain that is configured to condition a sharpening element. The dresser link may include a conditioning element with an outer edge that is offset from an outer side of the dresser link. The conditioning element may include a horizontal relief angle and/or a vertical relief angle. The saw chain may further include a cutter link having a cutting element. The horizontal and/or vertical relief angle may facilitate maintenance of a clearance between the cutting element and the conditioning element after wear of the cutting element and conditioning element.

11 Claims, 4 Drawing Sheets

DRESSER LINK FOR SAW CHAIN

CROSS REFERENCE TO RELATED APPLICATIONS

The present application claims priority to U.S. Provisional Patent Application No. 61/728,744, filed Nov. 20, 2012, entitled "DRESSER LINK FOR SAW CHAIN," the entire disclosure of which is hereby incorporated by reference in its entirety.

TECHNICAL FIELD

Embodiments herein relate to the field of saw chains, and, more specifically, to dresser links for saw chains.

BACKGROUND

Saw chains for wood chainsaws include cutter links having sharp cutting elements for cutting through wood. The cutting elements may become dull from repeated use. Accordingly, the cutting elements may be periodically sharpened to extend the life of the saw chain. In some cases, the cutting element may be sharpened by bringing a sharpening stone into contact with the cutting element while the cutter link traverses a guide bar of the chainsaw. Some saw chains further include one or more dresser links (also referred to as conditioning links) having a region with a conditioning material to condition the sharpening stone in order to compensate for grooves that may be formed by the cutting element and/or other chain elements.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1A:
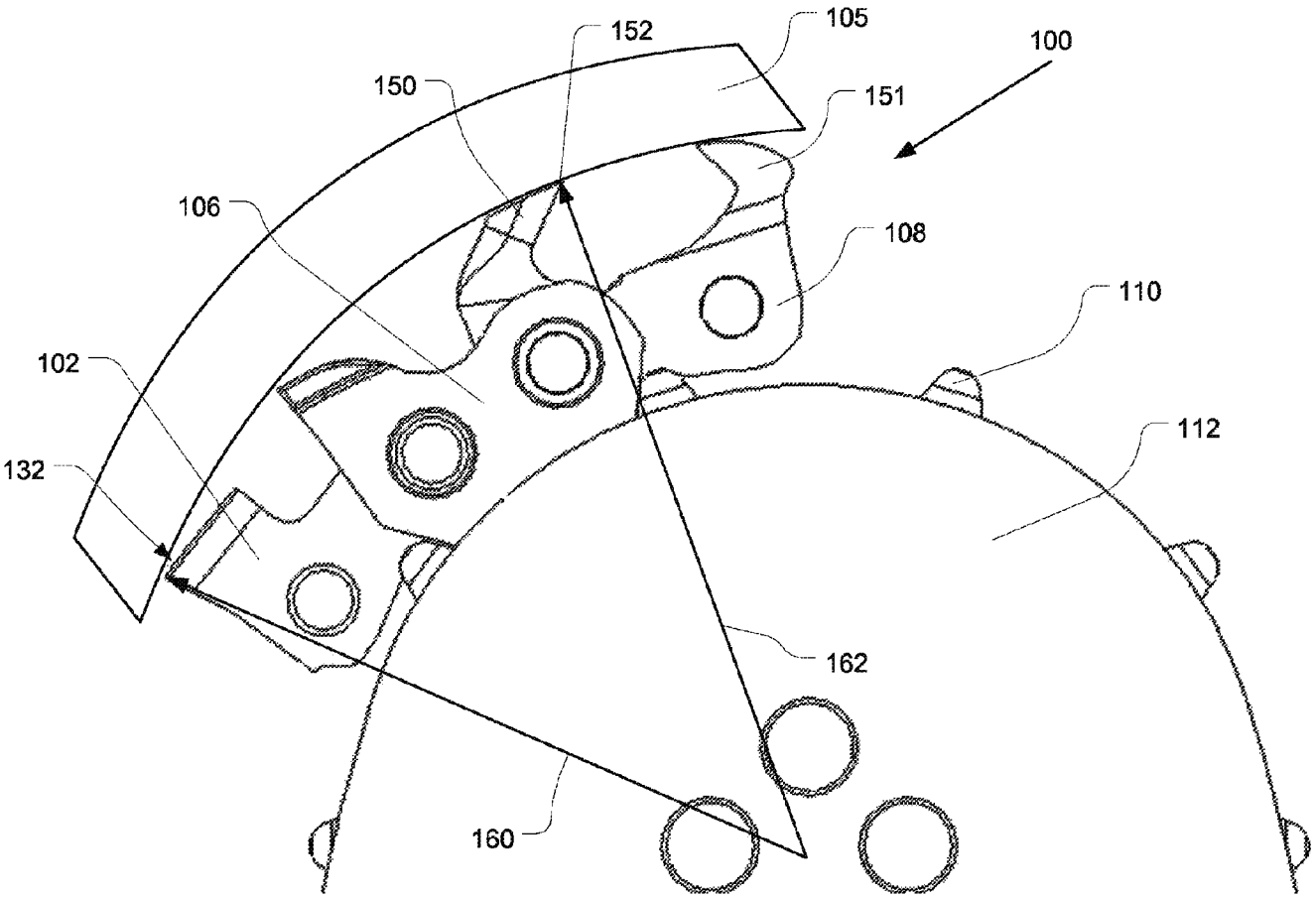
FIG. 1A illustrates a side view of a portion of a saw chain including a left dresser link, a drive link, and a cutter link, as the saw chain traverses a sprocket of a guide bar, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Embodiments herein provide a dresser link for a saw chain to condition a sharpening element. The dresser link may include a body with a conditioning element extending upward from the body. The conditioning element may include a conditioning material. The conditioning material may be an abrasive material, such as a diamond coating. In various embodiments, the conditioning element may include a horizontal relief angle and/or a vertical relief angle, as further described below.

In some embodiments, the horizontal relief angle and/or vertical relief angle may correspond to similar angles on a cutter link of the saw chain. The width of the cutter link may narrow over time (e.g., from sharpening and/or use). The horizontal relief angle and/or vertical relief angle may provide a corresponding narrowing of the width of the conditioning element to maintain a relative arrangement of the conditioning element with the cutter link. Additionally, or alternatively, the horizontal relief angle and/or vertical relief angle may also expose more abrasive elements (e.g., diamonds) on the conditioning element to facilitate conditioning of the sharpening element, among other benefits.

In various embodiments, the saw chain may include a plurality of links coupled to one another, including one or more dresser links (also referred to as conditioning links), cutter links, and/or drive links. The cutter links may include a sharpened cutting element, for example for cutting wood. The cutting element may be sharpened by bringing a sharpening element, such as a sharpening stone, into contact with the cutting element as the saw chain is driven on the chainsaw (e.g., as the cutter link traverses the drive sprocket, nose sprocket, and/or another portion of a guide bar of the chainsaw). The sharpening element may be selectively actuated to bring the sharpening element into contact with the saw chain.

In various embodiments, the conditioning material of the dresser link may contact the sharpening element when the sharpening element is actuated. Accordingly, the dresser link may condition the sharpening element, including, but not limited to, shaping, cleaning, treating, evening out wear, and/or resizing the sharpening element. For example, the conditioning material may smooth the surface of the sharpening element to remove grooves caused by other elements of the saw chain, such as the cutting elements, depth gauges, and/or stabilizing elements.

In some embodiments, the saw chain may include left and right dresser links that contact different regions of the sharpening element. For example, the left dresser link may include a conditioning element configured to contact a left side of the sharpening element (e.g., at a first contact region), and the right dresser link may include a conditioning element configured to contact a right side of the sharpening element (e.g., at a second contact region). In some embodiments, the first and second contact regions may not overlap. In other embodiments, the first and second contact regions may overlap.

In some embodiments the left and right dresser links may be coupled opposite one another in the saw chain. For example, the left and right dresser links may be coupled together by one or more rivets. The left and right dresser links may or may not have a different structure from one another. For example, in some embodiments, a pair of dresser links of the same design may be used for the left and right dresser links. Alternatively, the left and right dresser links may be of different designs, for example they may be mirror images of one another.

In other embodiments, the left and right dresser links may not be directly opposite one another in the saw chain. For example, the left and right dresser links may be adjacent to one another, and/or separated by one or more other links in the saw chain.

In various embodiments, the body of the dresser link may have an outer side and an inner side. In some embodiments, the conditioning element may extend outward over the outer side of the body. The conditioning element may include an upper surface that extends over the outer side of the body and is oriented generally horizontally. The conditioning element may further include a side surface that extends downward from the upper surface. The junction between the upper surface and the side surface of the conditioning element may be referred to as the outer edge of the conditioning element. The outer edge of the conditioning element may define an offset of the conditioning link, defined as the perpendicular distance of the outer edge from a vertical plane aligned in the direction of travel along a centerline of the saw chain.

As discussed above, the dresser link may include a horizontal relief angle and/or a vertical relief angle. The horizontal relief angle may be defined as the angle of the outer edge of the conditioning element with respect to the direction of travel of the saw chain (e.g., measured in a horizontal plane). The dresser link may be said to include a horizontal relief angle if the horizontal relief angle is non-zero (e.g., the outer edge of the conditioning element is not parallel to the direction of travel). In other words, the offset of the conditioning element may vary along a length of the outer edge. In some embodiments, the offset may increase from a forward portion of the conditioning element to a rear portion of the conditioning element.

The vertical relief angle may be defined as the angle of the side surface of the conditioning element with respect to a vertical plane (e.g., a vertical plane bisecting the body of the dresser link). The dresser link may be said to include a vertical relief angle if the vertical relief angle is non-zero (e.g., the side surface of the conditioning element is not parallel to the vertical plane). In some embodiments, the side surface may be slanted downward toward the outer surface of the body from the outer edge of the conditioning element, thereby defining the vertical relief angle.

Some embodiments of the dresser link may include both a horizontal relief angle and a vertical relief angle. Other embodiments may include only one of a horizontal relief angle or a vertical relief angle.

In some embodiments, the cutting element may extend over a side of the cutter link. In one embodiment, the cutting element may include a sharpened cutting edge that is twisted and/or bent out of the vertical plane and extends horizontally over the outer side of the cutter link. The cutting element may include an outer edge that terminates at the end of the sharpened cutting edge (e.g., the end that is most extended over the outer side of the cutter link). In some embodiments, the outer edge of the cutting element may define a horizontal relief angle. In some embodiments, the outer edge of the cutting element may be most offset at the end of the cutting edge, and the offset may decrease as the outer edge moves away from the cutting edge (opposite the direction of travel). Thus, in some embodiments, the outer edge of the cutting element may run further from the centerline of the saw chain in the direction of travel, while the outer edge of the dresser link may run closer to the centerline of the saw chain in the direction of travel.

Additionally, or alternatively, the cutting element may include a side surface that extends downward from the outer edge and defines a vertical relief angle.

In various embodiments, the horizontal relief angle of the dresser link may correspond to the horizontal relief angle of the cutting element. For example, the horizontal relief angles of the dresser link and the cutting element may have substantially the same magnitude with respect to the direction of travel. In other embodiments, the magnitude of the dresser link's horizontal relief angle may differ from the magnitude of the cutter link's horizontal relief angle, for example to account for different wear characteristics (e.g., wear rate) of the conditioning element compared with the cutting element. In some embodiments, the orientation/polarity of the horizontal relief angles may be different, such as in embodiments in which the offset of the dresser link's outer edge decreases in the direction of travel while the offset of the cutter link's outer edge increases in the direction of travel. In some embodiments, the magnitude of the dresser link's horizontal relief angle may be about 1 degree to about 10 degrees, such as about 3 degrees.

Additionally, or alternatively, the vertical relief angle of the dresser link may correspond to the vertical relief angle of the cutter link. For example, the vertical relief angles may have the same magnitude with respect to the vertical plane. In other embodiments, the magnitude of the dresser link's vertical relief angle may differ from the magnitude of the cutter link's vertical relief angle, for example to account for different wear characteristics (e.g., wear rate) of the conditioning element compared with the cutting element. In some embodiments, the magnitude of the vertical relief angle of the dresser link may be about 1 degree to about 15 degrees, such as about 8 degrees.

In various embodiments, the horizontal relief angle and/or vertical relief angle of the dresser link may be configured to produce wear in the conditioning element that is similar to the wear in the cutting element (e.g., due to cutting and/or sharpening). For example, as the cutting element is sharpened, the cutting element may recede further down the outer edge of the cutting element. Accordingly, the offset of the cutting element may decrease over time due to the horizontal relief angle in the outer edge of the cutting element. The horizontal relief angle of the dresser link may facilitate similar wear in the conditioning element, so that the offset of the conditioning element changes by a similar amount to the offset of the cutting element.

In various embodiments, the cutting element may also wear downward, which may cause the offset of the cutting element to decrease due to the vertical relief angle of the cutting element. The vertical relief angle of the dresser link may facilitate a corresponding change in the offset of the conditioning element.

In various embodiments, the offset of the cutting element may extend further from a center vertical plane of the saw chain than the offset of the conditioning element. This difference may be referred to as a clearance of the cutting element compared with the conditioning element. The clearance may provide several benefits, such as improved sharpening of the cutting element and/or improved stability of the cutting element during sharpening. Additionally, or alternatively, the clearance may facilitate cutting performance by the cutting element.

In various embodiments, the horizontal relief angle and/or vertical relief angle of the conditioning element may maintain the clearance between the cutting element and the conditioning element through continued use and/or sharpening of the saw chain.

In various embodiments, the wear facilitated by the horizontal relief angle and/or vertical relief angle may also cause the conditioning element to contact the sharpening element with different abrasive elements (e.g., diamonds) as the conditioning element wears. Accordingly, the conditioning element may provide a fresh surface for better sharpening of the sharpening element.

Furthermore, having a horizontal relief angle and/or vertical relief angle that corresponds to similar angles on the cutting element may facilitate the conditioning element to condition the sharpening element in a shape that is conducive to sharpening the cutting element.

In various embodiments, the dresser link and/or cutter link may be designed so that the radial extension of the conditioning element may be substantially the same as the radial extension of the cutting element when the dresser link and cutter link are traversing a curved portion of the guide bar (e.g., traversing the nose sprocket or drive sprocket). The radial extension of a saw chain element may be the distance of the saw chain element from the center of rotation of the sprocket of the guide bar. For example, the points of the outer edges of the conditioning element and/or cutting element that are most offset from the center of the saw chain (e.g., the rear portion of the conditioning element and the forward portion of the cutting element) may have substantially the same radial extension. This may facilitate effective conditioning of the sharpening element to provide effective sharpening of the cutting element, and/or facilitate stability of the cutter link and/or dresser link.

In some embodiments, the radial extension of the conditioning element may be greatest at the portion that is most offset from the vertical plane (e.g., the rear portion). Similarly, the radial extension of the cutting element may be greatest at the portion that is most offset from the vertical plane (e.g., the front portion). This may facilitate wear along the outer edge starting from the most offset portion, as described herein.

Figure 1B:
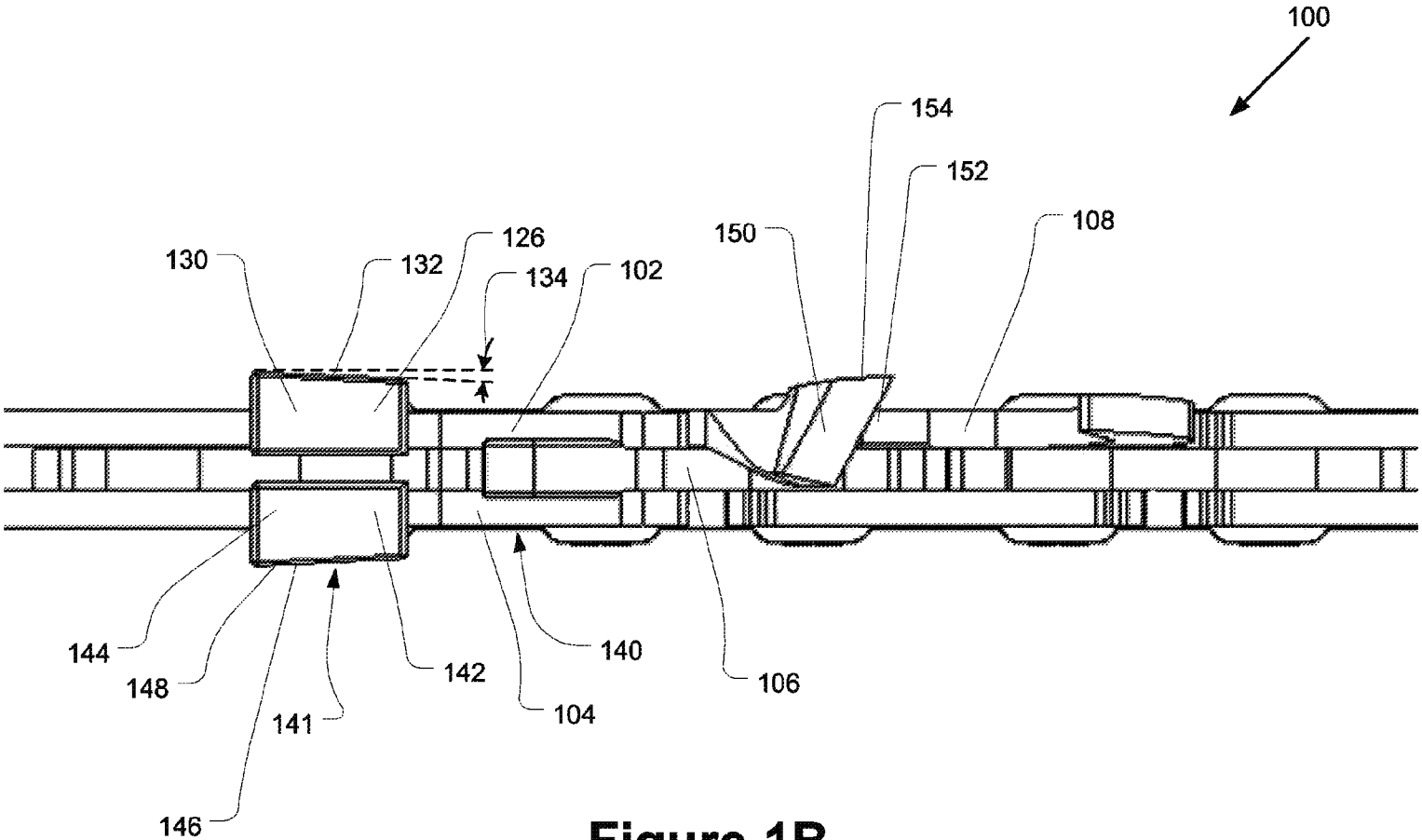
FIG. 1B illustrates a top view of the portion of saw chain of FIG. 1A, also including a right dresser link.
Figure 1C:
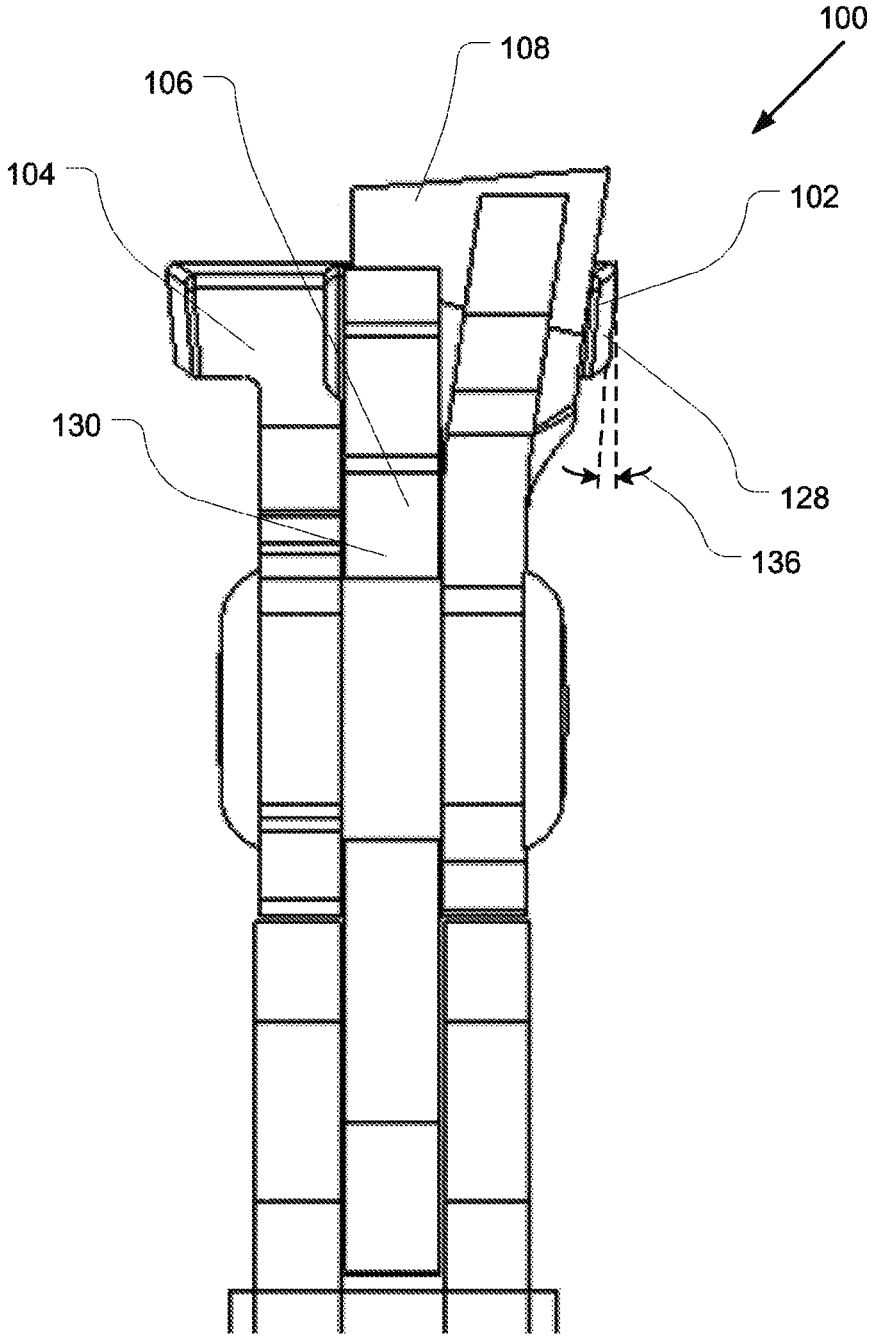
FIG. 1C illustrates a front view of the portion of saw chain of FIG. 1B.

FIGS. 1A, 1B, and 1C illustrate a portion of a saw chain 100 in accordance with various embodiments. Saw chain 100 includes a left dresser link 102, a right dresser link 104, a dresser drive link 106, and a cutter link 108. Left dresser link 102 and right dresser link 104 are coupled opposite one another on saw chain 100 (see FIG. 1B). FIG. 1A shows the saw chain 100 with the right dresser link 104 removed for clarity. Additionally, in FIG. 1A, saw chain 100 is shown traversing a sprocket 110 in operable association with chainsaw guide bar 112. F*igure* 1A further illustrates a portion of a sharpening element 105 that may be disposed adjacent the sprocket 110 and may interact with the saw chain 100.

Figure 2B:
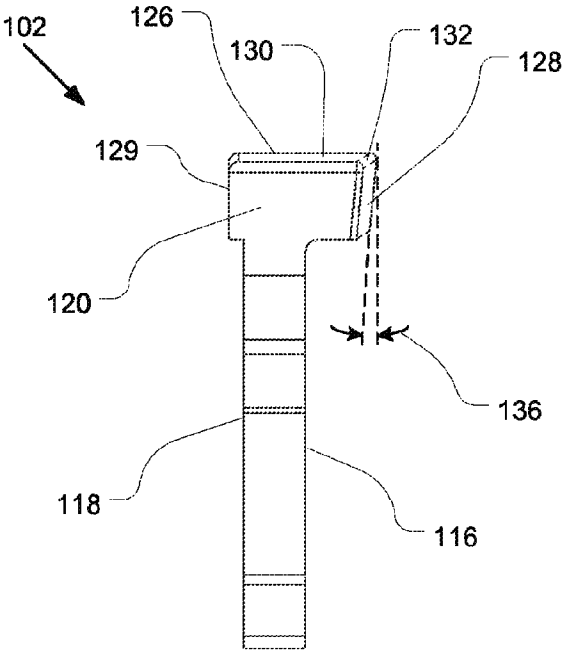
FIG. 2B illustrates a front view of the left dresser link of FIG. 1A.
Figure 2A:
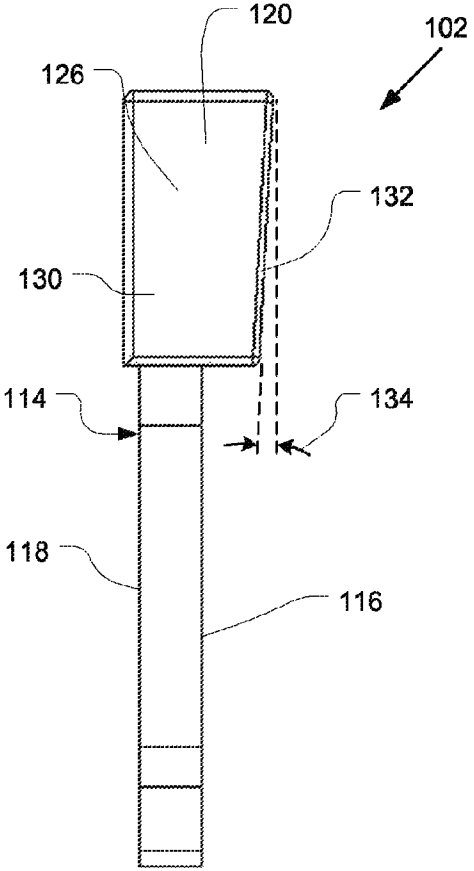
FIG. 2A illustrates a top view of the left dresser link of FIG. 1A.

Additional views of left dresser link 102 are shown in FIGS. 2A and 2B.

Left dresser link 102 includes a body 114 with an outer side 116 and an inner side 118. A conditioning element 120 extends upward over a rear portion of left dresser link 102 and extends over the sides of the body 114. The conditioning element 120 extends further over outer side 116 than over inner side 118 of left dresser link 102. A conditioning material 130 is disposed on an upper surface 126 and a side surface 128 of the conditioning element 120. In some embodiments, the conditioning material 130 may also be disposed on side surface 129. The conditioning material 130 may be an abrasive material, such as a diamond coating. The upper surface 126 of the conditioning element 120 is substantially flat. The upper surface 126 is sloped slightly downward in the direction of travel (e.g., from the rear to the front of the conditioning element 120). In other embodiments, the upper surface 126 may be parallel to the direction of travel of the saw chain 100, sloped upward, and/or may include a curved portion. The conditioning element 120 includes an outer edge 132 at the junction of the upper surface 126 and side surface 128. The outer edge 132 is offset from the outer side 116 of the body 114.

As best seen in FIGS. 1B and 2A, left dresser link 102 includes a horizontal relief angle 134. Horizontal relief angle 134 is the angle of the outer edge 132 with respect to the direction of travel. As shown, the horizontal relief angle 134 is about 3 degrees. In other embodiments, the horizontal relief angle 134 may be any suitable angle, such as an angle of about 1 to 10 degrees.

As best seen in FIGS. 1C and 2B, left dresser link 102 further includes a vertical relief angle 136. The vertical relief angle 136 is the angle of the side surface 128 of the conditioning element 120 with respect to a vertical plane. As shown, the vertical relief angle 136 is about 8 degrees. In other embodiments, the vertical relief angle 136 may be any suitable angle, such as an angle of about 1 to 15 degrees.

The right dresser link 104 is a mirror image of left dresser link 102 and includes similar features to those of left dresser link 102. Right dresser link 104 includes a body 140 with a conditioning element 141. A conditioning material 142 is disposed on an upper surface 144 and one or both side surfaces of the conditioning element 141. An outer edge 148 may be formed at the junction of the upper surface 144 and side surface 146.

The cutter link 108 further includes a cutting element 150 and a depth gauge 151. The cutting element 150 includes a sharpened cutting edge 152 that extends over an outer side of the cutter link 108. The cutting element 150 may further include an outer edge 154 that defines an offset of the cutter link 108. In various embodiments, the horizontal relief angle 134 may correspond to a horizontal relief angle defined by the outer edge 154 of the cutting element 150. For example, the horizontal relief angle 134 may be configured so that the outer edge 132 of the conditioning element 120 matches a wear characteristic of the outer edge 154 of the cutting element 150. The vertical relief angle 136 may be further configured so that the conditioning element 120 matches the wear characteristic of the outer edge 154 of the cutting element 150 in the vertical direction.

As shown in FIG. 1A, a radial extension 160 of outer edge 132 of the left dresser link 102 may be the same as a radial extension 162 of the cutting edge 152 of cutting element 150 as the left dresser link 102 and cutter link 108 traverse the sprocket 110.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A saw chain comprising:

a cutter link having an outer edge that defines an offset of the cutter link, and a cutting element to be sharpened by a sharpening element; and a dresser link coupled to the cutter link, the dresser link including:

a body having an outer side and an inner side;

a conditioning element extending up from the body and configured to condition the sharpening element, the conditioning element having an upper surface that extends over the outer side of the body and defines an outer edge of the conditioning element;

wherein the conditioning element includes a horizontal relief angle between the outer edge of the conditioning element and a direction of travel of the saw chain; wherein a distance from the outer edge of the conditioning element to a vertical plane aligned with the direction of travel of the saw chain decreases in a direction of the saw chain to define the horizontal relief angle.

2. The saw chain of claim 1, wherein the conditioning element further includes a side surface that meets the upper surface at the outer edge, and wherein the conditioning element further includes a vertical relief angle between the side surface and the vertical plane aligned in the direction of travel of the saw chain.

3. The saw chain of claim 2, wherein the outer edge of the conditioning element defines a first offset distance from a furthest point of the outer edge of the conditioning element to the vertical plane, wherein the cutting element includes a cutting edge that defines a second offset distance from a furthest point of the cutting edge to the vertical plane, and wherein the second offset is greater than the first offset.

4. The saw chain of claim 3, wherein the horizontal relief angle is configured to maintain a clearance between the second offset and the first offset after wear on the cutting element and the conditioning element.

5. The saw chain of claim 1, wherein the horizontal relief angle is about 1 degree to about 10 degrees.

6. The saw chain of claim 1, wherein the horizontal relief angle of the conditioning element corresponds to a horizontal relief angle of the cutting element to maintain a clearance between the cutting element and the conditioning element after wear on the cutting element and conditioning element.

7. The saw chain of claim 6, wherein the horizontal relief angle of the conditioning element has a different magnitude than the horizontal relief angle of the cutting element to account for different wear characteristics of the conditioning element compared with the cutting element.

8. A system for a chainsaw comprising:

a guide bar having a sprocket;

a sharpening element disposed adjacent the sprocket;

a saw chain configured to traverse the guide bar, the saw chain including:

a cutter link having an outer edge that defines an offset of the cutter link, and a cutting element to be sharpened by the sharpening element; and a dresser link coupled to the cutter link, the dresser link including:

a body having an outer side and an inner side;

a conditioning element extending up from the body and configured to condition the sharpening element, the conditioning element having an upper surface that extends over the outer side and a side surface that drops down from the upper surface at an outer edge of the conditioning element;

wherein the conditioning element includes a horizontal relief angle between the outer edge of the conditioning element and a direction of travel of the saw chain, and a vertical relief angle between the side surface of the conditioning element and a vertical plane aligned in the direction of travel of the saw chain;

wherein a distance from the outer edge of the conditioning element to the vertical plane decreases in the direction of travel of the saw chain to define the horizontal relief angle.

9. The system of claim 8, wherein the horizontal and vertical relief angles of the conditioning element are configured to maintain a horizontal clearance between the cutting element and the conditioning element after wear of the cutting element and conditioning element.

10. The system of claim 8, wherein the horizontal relief angle is about 1 degree to about 10 degrees.

11. The system of claim 8, wherein the vertical relief angle is about 1 to about 15 degrees.

* * * * *